US005772080A

United States Patent [19]

de Pous et al.

[11] Patent Number: 5,772,080

[45] Date of Patent: Jun. 30, 1998

[54] FIXING RING WITH DUAL INDEXING

[75] Inventors: Olivier de Pous, Paris; Claude Jouillat, La Marette, both of France

[73] Assignee: Valois S.A., Le Neubourg, France

[21] Appl. No.: 692,798

[22] Filed: Jul. 30, 1996

[30] Foreign Application Priority Data

Aug. 1, 1995 [FR] France ..... 95 09363

[51] Int. Cl.[6] ..... B65D 83/40; B67D 5/32

[52] U.S. Cl. ..... 222/321.7; 222/153.13; 222/321.9

[58] Field of Search ..... 222/321.7, 321.9, 222/384, 153.11, 153.13, 402.11, 385

[56] References Cited

U.S. PATENT DOCUMENTS

| | | | |
|---|---|---|---|
| 3,179,306 | 4/1965 | Corsette | 222/384 X |
| 3,401,843 | 9/1968 | Ahrens et al. | 222/384 X |
| 3,422,996 | 1/1969 | Lipman | 222/402.11 |
| 3,484,023 | 12/1969 | Meshberg | 222/402.11 |
| 3,608,791 | 9/1971 | Jordan et al. | 222/402.11 |
| 3,848,778 | 11/1974 | Meshberg | 222/402.11 |
| 4,071,173 | 1/1978 | Horan | 222/402.11 X |
| 4,324,351 | 4/1982 | Meshberg | 222/402.11 |
| 4,434,915 | 3/1984 | Kirk, Jr. | 222/321.9 X |
| 5,096,094 | 3/1992 | Guilbert | 222/321.9 X |
| 5,562,219 | 10/1996 | De Pous et al. | 222/321.9 X |
| 5,642,908 | 7/1997 | Mascitelli | 222/321.7 X |

FOREIGN PATENT DOCUMENTS

| | | |
|---|---|---|
| 0 005 119 A1 | 10/1979 | European Pat. Off. . |
| 0 151 973 A2 | 8/1985 | European Pat. Off. . |
| 0 455 552 A1 | 11/1991 | European Pat. Off. . |
| 83 03077 | 8/1984 | France . |
| 39 93 508 A1 | 8/1990 | Germany . |
| 1414957 | 11/1975 | United Kingdom . |
| 92/04275 | 3/1992 | WIPO . |

*Primary Examiner*—Kevin P. Shaver
*Attorney, Agent, or Firm*—Rockey, Milnamow & Katz, Ltd.

[57] ABSTRACT

A fixing ring is provided for fixing a dispenser member on a neck of a receptacle containing a substance to be dispensed. The fixing ring includes a fixing structure for being fixed to the neck and includes a through opening for the top end of the dispenser member. The top end of the dispenser member is adapted to receive an actuator member, and includes an outlet opening for the substance. The fixing ring further includes (1) a first indexing structure cooperating with a first indexing member provided on the neck of the receptacle to fix the angular position of the ring relative to the neck, and (2) a second indexing structure cooperating with a second indexing member on the actuator member to fix the angular position of the actuator member relative to the ring, such that the angular position of the outlet opening of the actuator member is fixed relative to the receptacle.

8 Claims, 5 Drawing Sheets

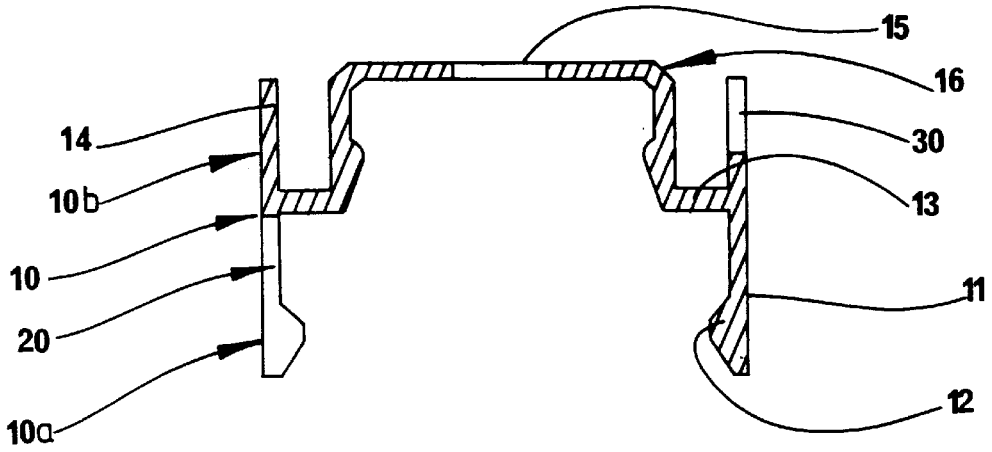
FIG.2
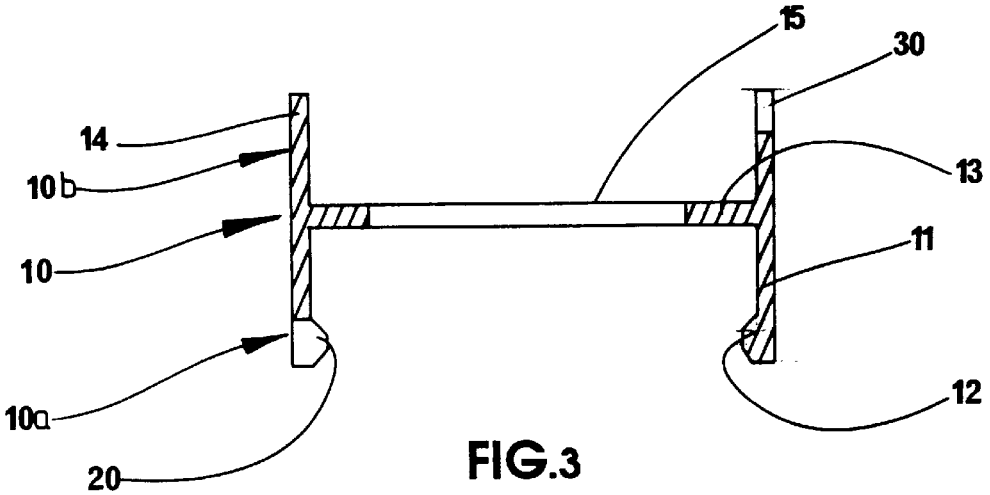
FIG.3
FIG.4
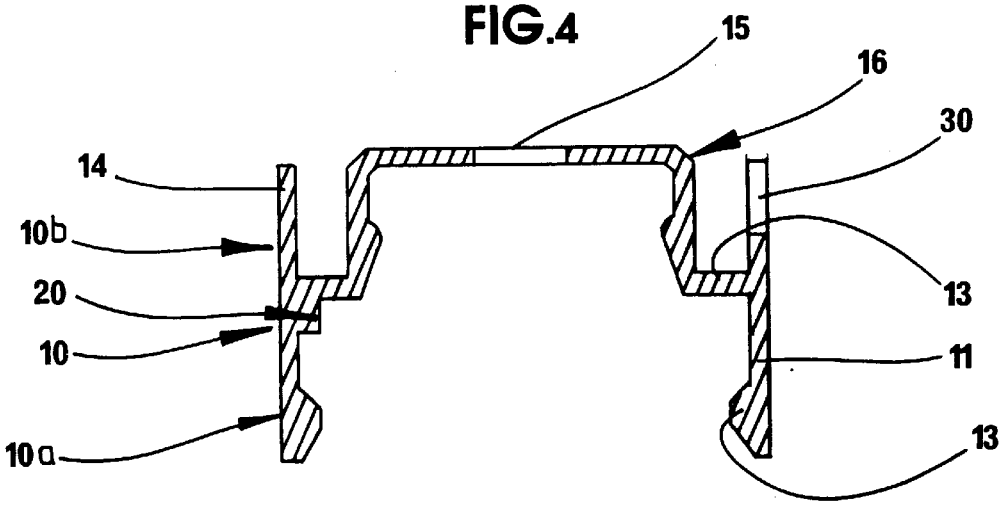

FIXING RING WITH DUAL INDEXING

The present invention relates to a ring for fixing a dispenser member on a neck of a receptacle containing a substance to be dispensed, and more particularly it relates to a snap-fastening ring for fixing a pump to the receptacle neck.

BACKGROUND OF THE INVENTION

It is known in the state of the art to fix a dispenser member to a receptacle neck by means of a ring that makes it possible to avoid crimping, thereby facilitating assembly of the device.

In that technique, a fixing ring is disposed on the body of a dispenser member and is fixed to the receptacle neck either by snap-fastening, e.g. by means of tabs provided for that purpose, or else by displacing material beneath said neck. A covering member, e.g. a hoop, can be engaged around said ring, either to hold it securely to the receptacle neck, if the ring snap-fastens, or else to perform said displacement of material beneath said neck.

A problem that arises with that type of fixing ring, particularly in the field of cosmetics, consists in determining the relative positioning of the nozzle and the receptacle. This applies particularly with flasks of special shape, where it is desired that the substance contained in the receptacle should be expelled in a specific direction relative to the receptacle.

OBJECTS AND SUMMARY OF THE INVENTION

An object of the invention is thus to provide a fixing ring enabling the direction in which substance is expelled relative to the receptacle to be determined in a manner that is simple and cheap.

The invention thus provides a fixing ring for fixing a dispenser member on a neck of a receptacle containing a substance to be dispensed, said fixing ring including fixing means fixing to said neck and including a through opening for the top end of the dispenser member, said top end of the dispenser member being adapted to receive an actuator member including an outlet opening for the substance, the fixing ring further including first indexing means co-operating with a first indexing member provided on said neck of the receptacle to fix the angular position of the ring relative to the neck, and second indexing means co-operating with a second indexing member secured to said actuator member to fix the angular position of the actuator member relative to the ring, such that the angular position of the outlet opening of the actuator member is fixed relative to the receptacle. An advantage of the invention lies in the fact that said fixing of the angular position of the nozzle relative to the receptacle can be performed during assembly of the device.

In a first embodiment of the invention, the first indexing means are implemented in the form of a profile projecting from the inside surface of said ring, and the first fixing member is implemented in the form of a cutout made in the neck of the receptacle, said profile being received in said cutout to fix the angular position of the ring relative to the neck of the receptacle.

In a second embodiment of the invention, the first indexing means are implemented in the form of a first cutout in the ring, and the first indexing member is implemented in the form of a first stud projecting from the neck of the receptacle, said first stud being received in said first cutout to fix the angular position of the ring relative to the neck of the receptacle.

Preferably, the second indexing means are implemented in the form of a second cutout in the ring, and the second indexing member is implemented in the form of a second stud projecting from the actuator member, said second stud being received in said second cutout to fix the angular position of the actuator member relative to the ring.

Advantageously, the ring includes a bottom portion and a top portion, the bottom portion including the fixing means and, at its top end, an annular bearing flange extending radially towards the inside of the ring, said flange bearing against the top end of the neck, the top portion including a cylindrical wall extending axially in line with the bottom portion, from the opposite side of said bearing flange, and in which the first indexing means are disposed in the bottom portion of the ring and the second indexing means are disposed in the top portion of the ring.

In an advantageous variant of the first embodiment of the invention, said profile is a stud projecting beneath said bearing flange, said stud being complementary in shape to the shape of said cutout made in the neck of the receptacle, such that said stud slides in said cutout when the ring is snap-fastened on the neck of the receptacle.

In particular, said fixing means are snap-fastening means.

Advantageously, the snap-fastening means are snap-fastening tabs distributed around the circumference of the ring, said tabs including snap-fastening studs for snap-fastening against the neck of the receptacle.

BRIEF DESCRIPTION OF THE DRAWINGS

Other characteristics and advantages appear from the following detailed description given by way of non-limiting example and with reference to the accompanying drawings, in which:

FIG. 2 is a diagrammatic section view of a variant of the FIG. 1*a* fixing ring;

FIG. 3 is a diagrammatic section view of a fixing ring constituting another embodiment of the invention;

FIG. 4 is a diagrammatic section view of a variant of the FIG. 1*c* fixing ring.

MORE DETAILED DESCRIPTION

Figure 5:
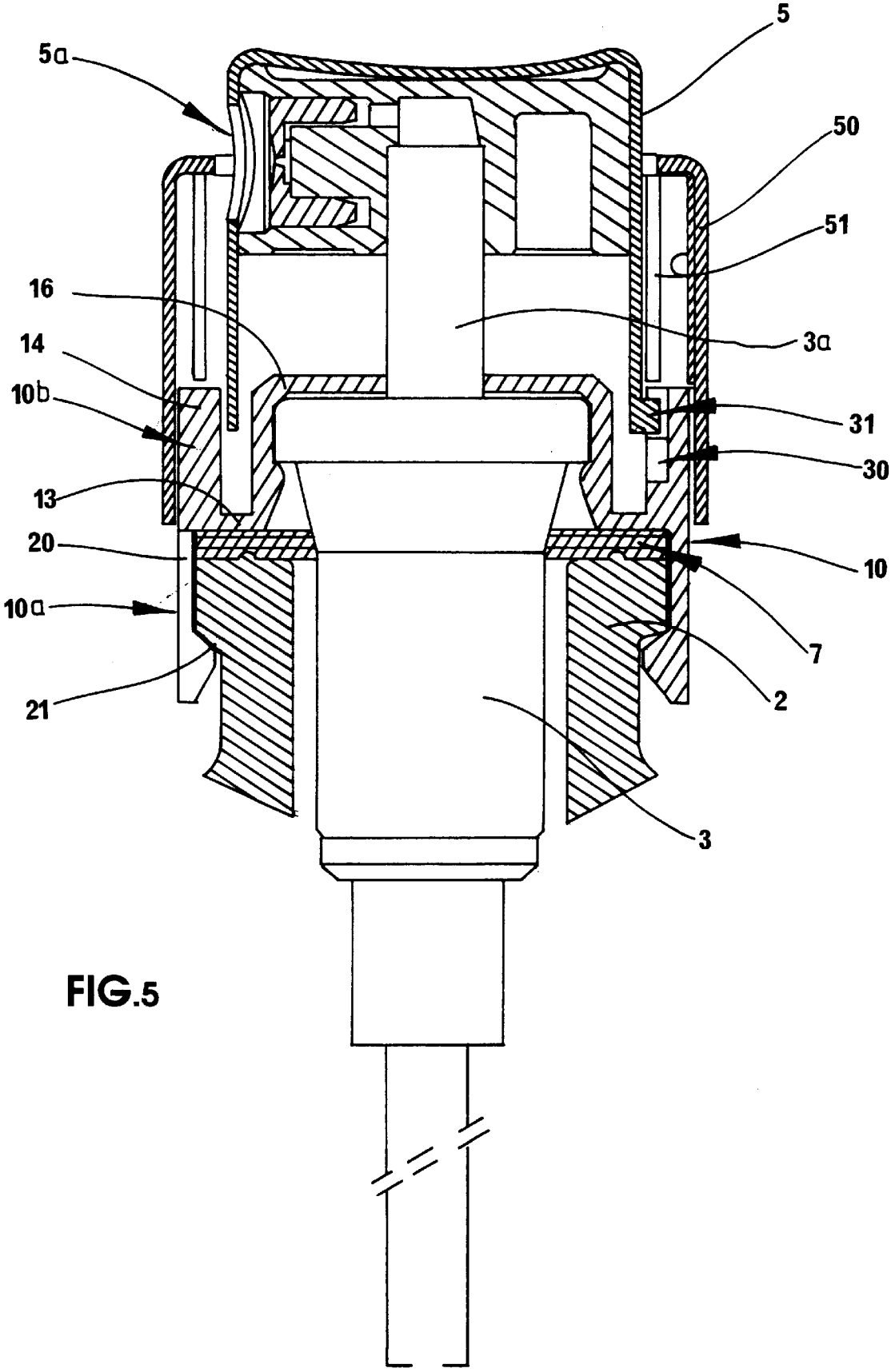
FIG. 5 is a diagrammatic section view of a dispenser member fixed to a receptacle neck by means of a fixing ring of the invention.

With reference to the figures, a substance dispenser comprises a receptacle 1 whose neck 2 presents a top edge, and a dispenser member 3 comprising a body which is extended at its top end by a dispenser head 3*a*. To fix the dispenser member 3 in the receptacle, an annular fixing ring 10 is used that comprises a bottom portion 10*a* and a top portion 10*b*. The bottom portion 10*a* of the ring includes a bearing flange 13 which is placed on a top portion of the neck 2. The dispenser member 3 is held on said neck 2 by means of a horizontal surface of said ring 10 including an opening 15 through which said dispenser head 3*a* passes. As shown in FIGS. 2, 4, and 5, the horizontal surface may form a turret 16 which receives in fixed manner a portion of the dispenser member 3. Optionally, a sealing gasket 7 is provided between the top surface of the neck 2 of the receptacle and the fixing ring 10. The dispenser head is adapted to receive an actuator member 5, such as a pushbutton, that includes an outlet opening 5*a* for the substance.

In the example shown in the figures, the fixing ring 10 is a ring of the snap-fastening type and it is generally made of plastics material. As shown in FIGS. 1*a*, 1*b*, 1*c*, 2, 4, and 5, the bottom portion 10*a* of said ring 10 advantageously includes a plurality of snap-fastening tabs 11 that are preferably uniformly distributed around its circumference and that extend vertically downwards. Each of the tabs 11 advantageously includes a snap-fastening stud 12 at its bottom end projecting from the inside surface of the ring and capable of being moved outwards a little when sufficient force is applied so as to pass over and then snap back under the enlarged top edge of the neck 2 of the receptacle 1.

In a variant of the snap-fastening means as shown in FIG. 3, the bottom portion 10*a* of the ring includes a cylindrical sleeve 11 having a peripheral bead 12 at its bottom end. The inside diameter of the sleeve 11 measured inside the bead 12 is slightly smaller than the outside diameter of the neck 2 of the receptacle, and said bead 12 snaps under the neck by deformation of the sleeve 11 which is advantageously made of a material that is relatively elastic and deformable.

The top portion 10*b* of the snap-fastening ring 10 preferably includes a cylindrical wall 14 extending axially in line with the snap-fastening tabs 12, from the opposite side of said flange 13.

After the ring 10 has been snap-fastened on the neck 2, a hoop 50 is generally engaged around said ring 10, in particular to prevent it from "unsnapping". The hoop 50 may be made of metal or of plastics material and it may optionally include reeding 51 on its inside surface which bears against the end of the ring 10, thus enabling the ring 10 to be snap-fastened by pressing down on the hoop 50.

According to the invention, the ring 10 includes first indexing means 20 that are preferably disposed inside its bottom portion 10*a*. These first indexing means 20 can be implemented in the form of a first cutout 20 in said bottom portion 10*a* of the ring. As can be seen in particular in FIGS. 1*a*, 1*b*, and 2, the cutout 20 advantageously extends axially up the entire height of the bottom portion 10*a* of the ring 10, at least as far as the bearing flange 13. This cutout 20 co-operates with a first indexing member 21 provided on the neck 2 of the receptacle. Advantageously, said first indexing member 21 is implemented in the form of a first stud 21 projecting from the neck 2. In the example shown in FIG. 1*a*, the stud 21 projects radially outwards from the portion of the neck that is situated beneath the enlarged edge of the neck. In this case, when the ring 10 is snapped onto the neck 2, the tabs 11 situated on either side of the cutout 20 snap behind the enlarged edge of the neck 2 on either side of said stud 21, which then prevents any angular rotation of the ring 10 on the neck 2.

Figure 1A:
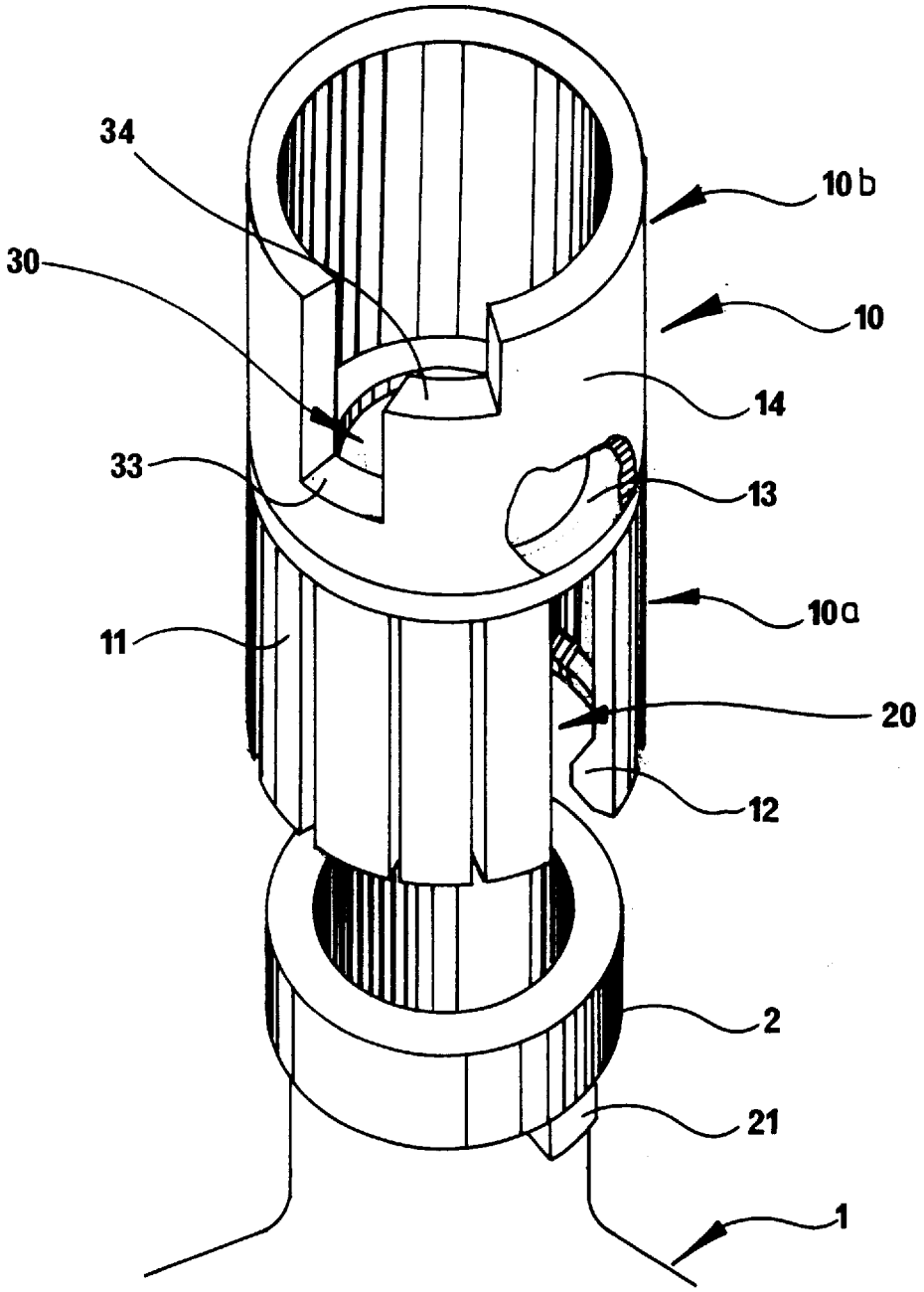
FIG. 1*a* is a partially exploded diagrammatic perspective view of a fixing ring constituting an embodiment of the invention.
Figure 1B:
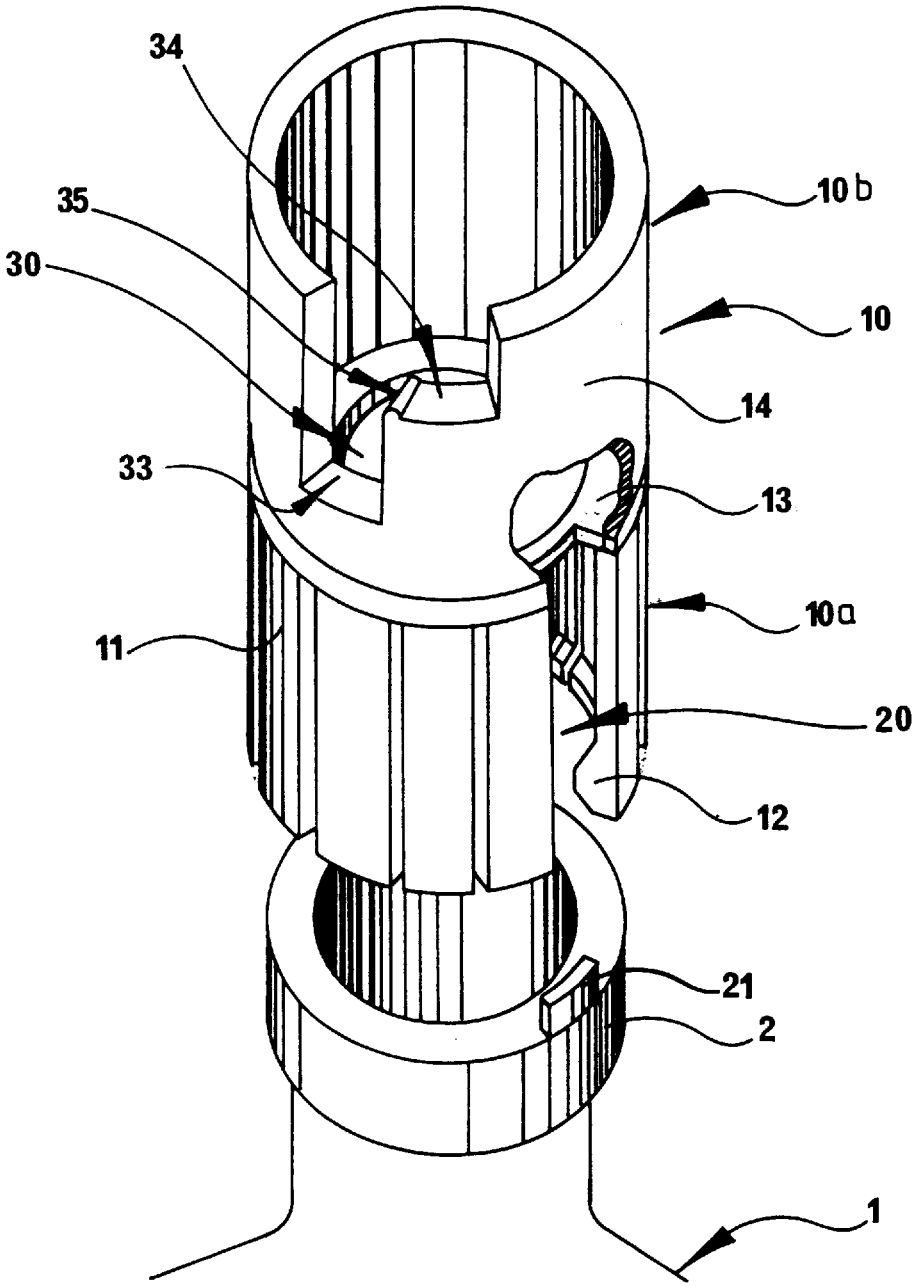
FIG. 1*b* is a partially exploded diagrammatic perspective view of a fixing ring constituting another embodiment of the invention.

In the other embodiment shown in FIG. 1*b*, the stud 21 projects vertically from the top end of said neck 2 and the cutout 20 in the ring 10 extends into the bearing flange 13.

Thus, on assembly, the ring 10 can be placed on the neck 2 in one angular position only, namely the position in which the stud 21 of the neck is received in the cutout 20 of the ring. When the ring 10 snaps onto the neck 2, the stud 21 slides in the cutout 20 until it penetrates into the bearing flange 13. Under such circumstances, it is the bearing flange 13 that surrounds said stud 21 after the ring 10 has been snapped into place, and that is prevented by the stud 21 from rotating on the neck 2. The angular position of the ring 10 on the neck 2 is thus fixed. Advantageously, the stud 21 does not extend from the full width of the top edge of the neck 2, thus making it possible for a peripheral gasket 7 to be placed between said neck 2 and said bearing flange 13.

Figure 1C:
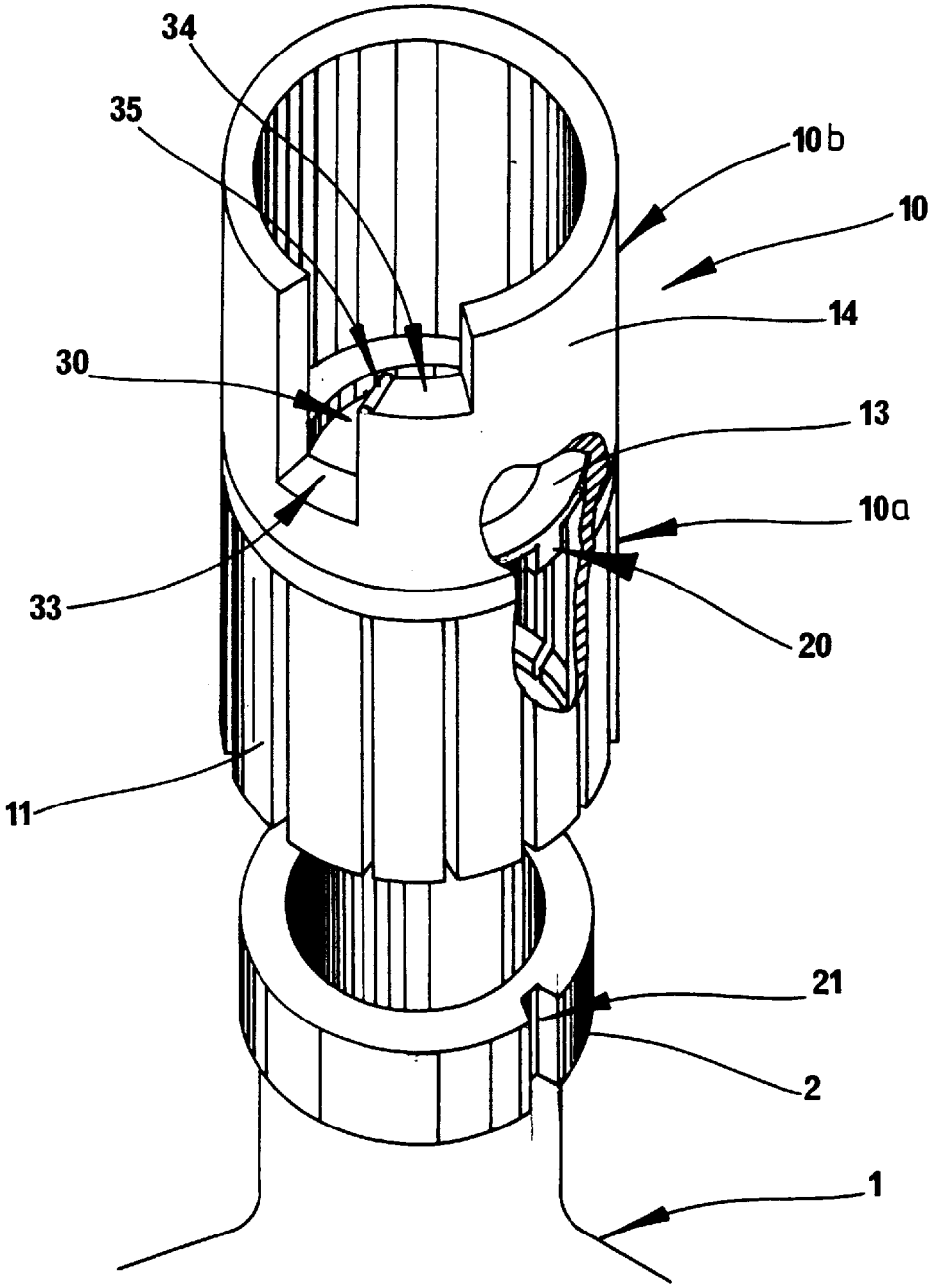
FIG. 1*c* is a partially exploded diagrammatic perspective view of a fixing ring constituting yet another embodiment of the invention.

In another embodiment of the invention, shown in particular in FIGS. 1*c* and 4, is it the first indexing member 21 which is made in the form of a cutout 21 in the neck 2 of the receptacle. This cutout 21 may be in the form of a vertical groove, as shown in FIG. 1*c*, but it could equally well be merely in the form of a discontinuity in the circular nature of the neck of the receptacle, e.g. a flat. The first indexing means 20 on the ring 10 are then implemented in the form of a profile corresponding to said cutout 21 of the neck. As can be seen in FIGS. 1*c* and 4, the profile is advantageously implemented in the form of a stud 20 projecting beneath the bearing flange 13 and co-operating with said cutout 21 in the neck when the ring 10 snap-fastens thereon. Thus, after the ring 10 has been put into place, the stud 20 of the ring is located in the cutout 21 of the neck and prevents one from rotating relative to the other.

In the embodiment of the snap-fastening means shown in FIG. 3, said cutout 20 does not extend up the full height of the bottom portion 10*a* of the ring 10, but is implemented only in the bead 12. This variant is optionally also adaptable to the snap-fastening tabs, in which case the cutout 20 is implemented merely by emitting a stud 12 from one of said tabs, and optionally associated with a cutout in the bearing flange.

In FIGS. 1*a*, 1*b*, and 1*c*, to clarify the figures, only one cutout 20 is shown in the ring 10 and only one stud 21 on the neck 2. Naturally, it is possible to provide a plurality of cutouts and respective co-operating studs, e.g. two of each, and they could advantageously be diametrically opposite.

According to the invention, the ring 10 further includes second indexing means 30 preferably disposed in the top portion 10*b*. These second indexing means 30 are preferably made in the form of a second cutout 30 in said top portion 10 of the ring. Advantageously, this cutout 30 is made from the top end of the cylindrical wall 14. This cutout 30 co-operates with a second indexing member 31, and in the embodiment shown in FIG. 5, the second indexing member 31 is provided on the actuator member 5 which is a pushbutton. Advantageously, said second indexing member 31 is made in the form of a second stud 31 projecting from the bottom end of said pushbutton 5, and preferably projecting radially.

Thus, on assembly, the actuator member or pushbutton 5 can be placed relative to the ring 10 in one angular position only, i.e. the position in which the stud 31 of the pushbutton 5 is received in the cutout 30 of the ring 10. In this manner, the angular orientation of the outlet opening 5*a* of the pushbutton 5 is fixed relative to the ring 10.

The cutout 30 may be implemented over the full depth of the cylindrical wall 14 (FIGS. 1 to 4) or merely over a fraction of said depth (FIG. 5).

Also, the cutout 30 may be of constant width up its entire height, as shown in FIG. 2, or it may have two different sections 33 and 34 of different heights, as shown in FIGS. 1*a*, 1*b*, 1*c*, and 5. Under such circumstances, the cutout 30 also acts as a safety device against involuntary actuation of the pushbutton 5, since prior rotation is required to bring said stud 31 over the deeper section 33. Optionally, as shown in FIGS. 1*b* and 1*c*, a rim 35 may be provided at the end of the shallower section 34 such that a small effort is required to bring the stud 31 over the deeper section 33 since it must first pass over said rim 35. Thus, unwanted rotation of the pushbutton is prevented, e.g. while it is being transported, the stud 31 secured to the pushbutton being held by the rim 35.

In yet another variant, shown in part in FIG. 3, the cutout 30 has only the shallower section and the stud 31 is located at a certain distance from the bottom end of the actuator member 5. Thus, on assembly, the actuator member 5 is mounted on the dispenser head 3*a* of the dispenser member 3 in any angular position relative to the ring 10. However, the actuator member 5 can only be actuated when the stud 31 is brought into an angular position such that it overlies said cutout 30 in the ring. Thus, the angular position of the outlet opening 5*a* of the pushbutton 5, during actuation, is determined relative to the ring 10.

Naturally, there may be a plurality of cutouts 30 and corresponding studs 31, e.g. two, in which case they are advantageously diametrically opposite.

Thus, by the combined effects of the first and second indexing means co-operating with the corresponding first and second indexing members, the invention makes it possible to determine and fix the direction in which substance is expelled from the receptacle, i.e. the angular position of the outlet opening 5*a* of the actuator member 5 relative to said receptacle.

The various characteristics described in association with the various embodiments of the invention may naturally be combined with one another in any manner without going beyond the ambit of the present invention.

We claim:

1. A combination comprising: (1) a receptacle containing a substance to be dispensed and having a neck, (2) a dispenser member having a top end to which is mounted an actuator member having an outlet opening, and (3) a fixing ring for fixing said dispenser member on said receptacle neck, said fixing ring including fixing means for attaching said fixing ring to said neck including a through opening for said dispenser member top end, said neck having a first indexing member, said actuator member having a second indexing member, said fixing ring further including first indexing means for cooperating with said first indexing member on said receptacle neck to fix the angular position of the ring relative to the neck, and said fixing ring further including second indexing means for cooperating with said second indexing member to fix the angular position of the actuator member relative to the ring, such that the angular position of the outlet opening of the actuator member is fixed relative to the receptacle.

2. The combination according to claim 1, in which said first indexing means include a projection extending from the inside surface of said ring, and said first fixing member includes a region of said receptacle neck which defines a cutout, said projection being received in said cutout to fix the angular position of the ring relative to the receptacle neck.

3. The combination according to claim 1, in which said first indexing means include a first cutout in said ring, and said first indexing member includes a first stud projecting from said receptacle neck, said first stud being received in said first cutout to fix the angular position of the ring relative to the receptacle neck.

4. The combination according to claim 1, in which the second indexing means include a second cutout in said ring, and said second indexing member includes a second stud projecting from said actuator member, said second stud being received in said second cutout to fix the angular position of said actuator member relative to the ring.

5. The combination according to claim 1, in which said ring includes a bottom portion and a top portion, said bottom portion having (1) a lower end including said fixing means and, (2) an upper end, said ring including an annular bearing flange extending radially towards the inside of the ring at said upper end of said ring bottom portion, said flange bearing against the top end of the neck, said ring top portion including a cylindrical wall extending axially in line with said ring bottom portion, from the opposite side of said bearing flange, and in which said first indexing means are disposed in said ring bottom portion and said second indexing means are disposed in said ring top portion.

6. The combination according to claim 5, in which said first indexing means include a projection extending from the inside surface of said ring, and said first indexing member includes a region of said receptacle neck which defines a cutout, said projection being received in said cutout to fix the angular position of the ring relative to said receptacle neck, and in which the said projection is a stud projecting beneath said bearing flange, said stud being complementary in shape to the shape of said cutout defined in said receptacle neck, such that said stud slides in said cutout when the ring is fixed on said receptacle neck.

7. The combination according to claim 1, in which said fixing means are snap-fastening means.

8. The combination according to claim 7, in which the snap-fastening means are snap-fastening tabs distributed around the circumference of the ring, said tabs including snap-fastening studs for snap-fastening against the neck of the receptacle.

* * * * *